US005835071A

United States Patent [19]

Phelps

[11] Patent Number: 5,835,071

[45] Date of Patent: Nov. 10, 1998

[54] SHIELDED ANTENNA CONNECTOR

[75] Inventor: Craig Phelps, Raleigh, N.C.

[73] Assignee: Ericsson, Inc., Research Triangle Park, N.C.

[21] Appl. No.: 719,790

[22] Filed: Sep. 25, 1996

[51] Int. Cl.[6] ..... H01Q 1/24; H01Q 1/50

[52] U.S. Cl. ..... 343/906; 343/702

[58] Field of Search ..... 343/906, 702, 343/900, 901; 439/916; H01Q 1/24, 1/50

[56] References Cited

U.S. PATENT DOCUMENTS 5,278,570 1/1994 Jaramillo et al. ..... 343/906
5,524,284 6/1996 Marcou et al. ..... 343/702

FOREIGN PATENT DOCUMENTS

601702A1 6/1994 European Pat. Off. ..... H01R 13/71
0 676 824 A 11/1995 European Pat. Off. .

*Primary Examiner*—Hoanganh T. Le
*Attorney, Agent, or Firm*—Jenkens & Gilchrist, P.C.

[57] ABSTRACT

An improved RF antenna connector providing a shielded RF connection point is disclosed. The improved antenna connector consist of a metal housing which substantially surrounds a metal contact acting as an RF feed point connector. The metal contact is placed within the housing by connection to an insulating connector that slides into a chamber in the housing such that the metal contact is located within and substantially surrounded by the housing. The metal contact is also positioned to contact the RF feed points of an antenna and a printed circuit board.

14 Claims, 4 Drawing Sheets

SHIELDED ANTENNA CONNECTOR

BACKGROUND OF THE INVENTION

1. Technical Field of the Invention

The present invention relates to antenna connectors, and more particularly, to shielded antenna connectors providing a shield ground and RF connector for interconnections between an antenna and a printed circuit board.

2. Description of Related Art

In the design of cellular telephones, the antenna connector is an essential component. However, the connector happens to be one of the more sensitive areas of the cellular telephone and yields many complex design challenges. Since all transmitted and received signals that the cellular telephone uses must pass through the antenna connection, it is important that the connector function with a minimum of interference.

Presently existing connectors for use with retractable antennas only include an RF connection point for the antenna and provide no ground line or ground shield. When a ground line is required for testing and matching circuitry, an additional coaxial connector must be added to the printed circuit board to provide the necessary test ground. This of course adds to the cost and complexity of the board. An antenna connector incorporating both the ground and RF feed line would be preferred.

Early attempts to produce antenna connectors incorporating both ground and RF feed lines, resulted in the ground line acting as a second antenna that received interference signals that disabled the RF feed line. Thus, the connector must be properly shielded in order to avoid this problem. Retractable or telescopic antenna connectors also must provide the ability for a retractable antenna to collapse or pass through the connector. Thus, an RF antenna design providing an RF feed point, proper ground shielding, and capabilities for use with retractable antennas is needed within the cellular telephone industry.

SUMMARY OF THE INVENTION

The present invention overcomes the foregoing and other problems with an improved RF antenna connector. The antenna connector includes a metal housing defining a pair of chambers within its interior. The housing acts as a ground shield and surrounds an antenna inserted into a first of these interior chambers. A formed metal contact provides a connection between the RF feed point of the antenna and an RF connector of an associated printed circuit board. The formed metal contact is stapled to an insulating connector that slides within the second interior chamber of the metal housing. Once the connector is inserted within the housing, the metal contact is positioned to engage the RF feed point of an antenna inserted within the first chamber and the RF feed point of a printed circuit board. The metal contact is also positioned such that it is substantially surrounded and shielded by the housing to limit interference from external sources.

BRIEF DESCRIPTION OF THE DRAWINGS

For a more complete understanding of the present invention, reference is made to the following detailed description taken in conjunction with the accompanying drawings wherein.

DETAILED DESCRIPTION OF THE DRAWINGS

Figure 1:
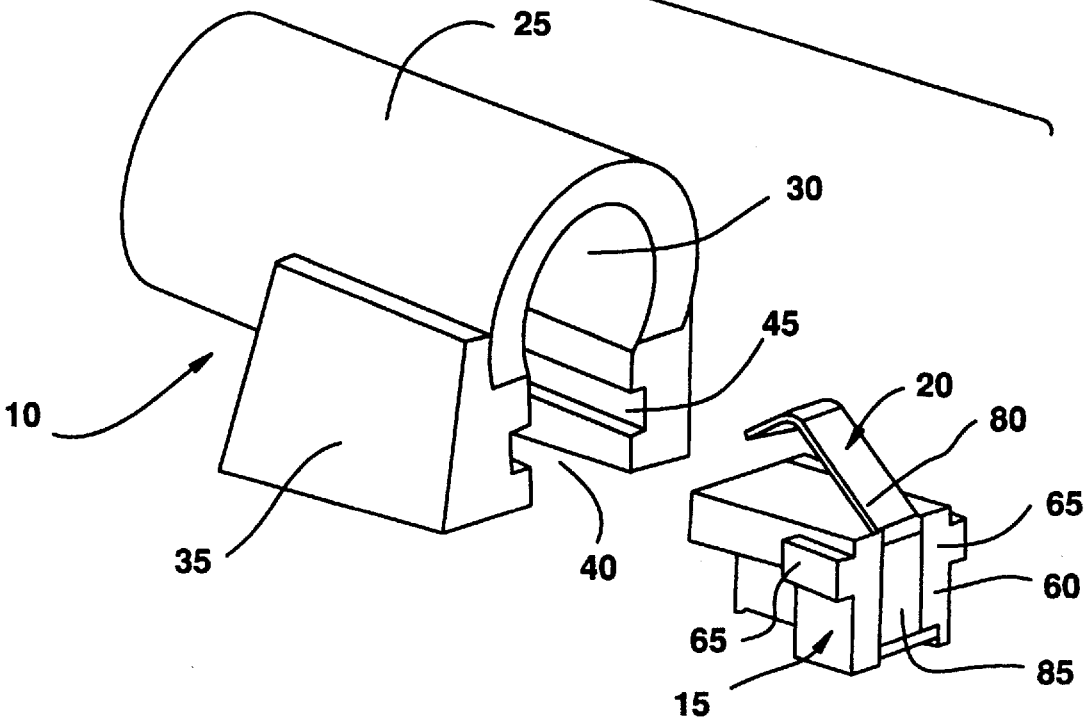
FIG. 1 is a perspective view of the top side of the antenna connector.
Figure 2:
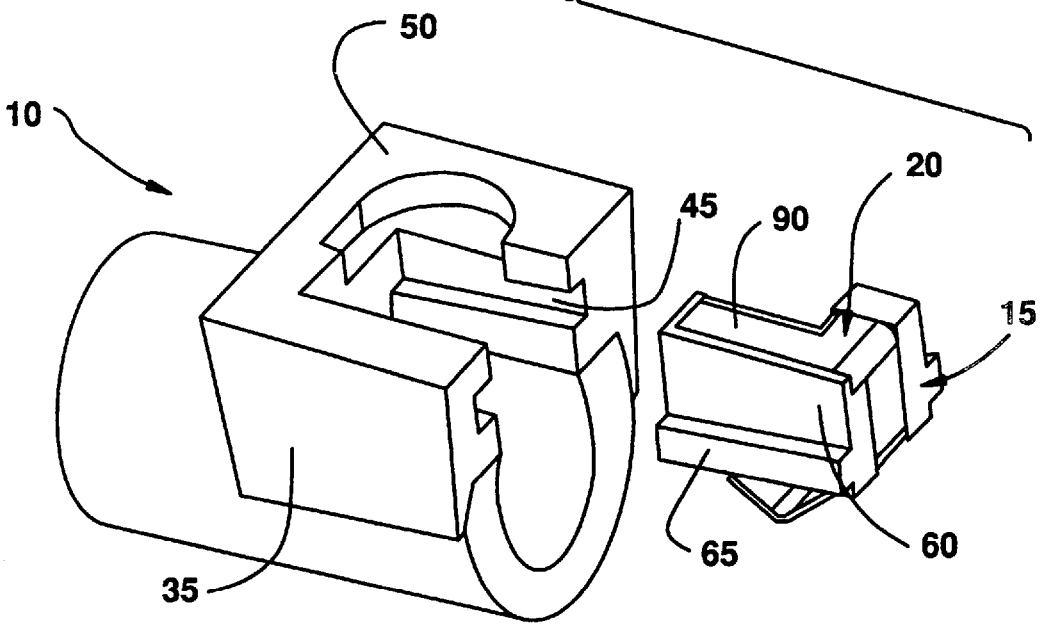
FIG. 2 is a perspective view of the bottom side of the antenna connector.

Referring now to the Drawings, and more particularly, to FIGS. 1 and 2, there is illustrated the antenna connector of the present invention. The connector consists of the connector housing 10, insulated connector insert 15 and the shaped metal contact 20.

Figure 3:
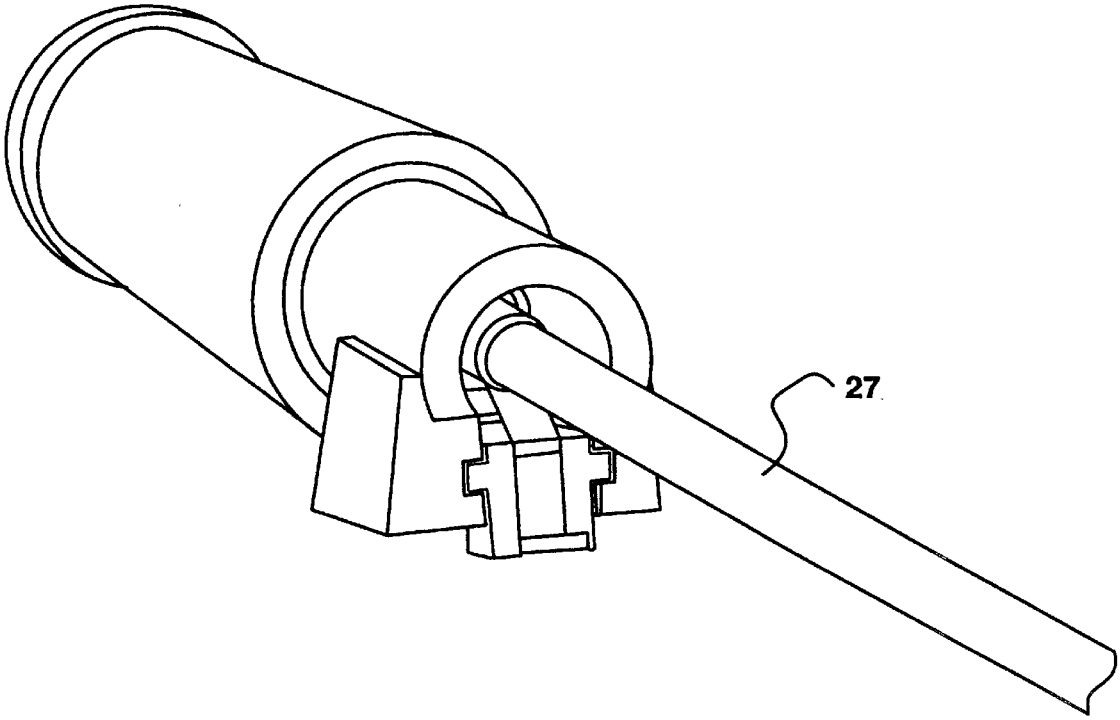
FIG. 3 is a perspective view illustrating an antenna inserted within the antenna connector.

The connector housing 10 consist of a barrel 25 having a substantially circular cross section for receiving an antenna 27 (FIG. 3) which is inserted into an antenna chamber 30 within the barrel 25 of housing 10. The connector housing 10 is preferably cast from a metal such as zinc. The surface of the housing 10 is plated with nickel to prevent oxidation and promote conductivity. The walls of the antenna chamber 30 may threadedly engage the antenna 27 or the antenna can be snapped or soldered into the chamber. The barrel 25 contacts the ground point of an antenna 27 when the antenna is inserted within antenna chamber 30. The barrel 25 of the housing 10 is further configured to enable the antenna 27 inserted within the antenna chamber 30 to retract and extend through the housing.

Figure 4:
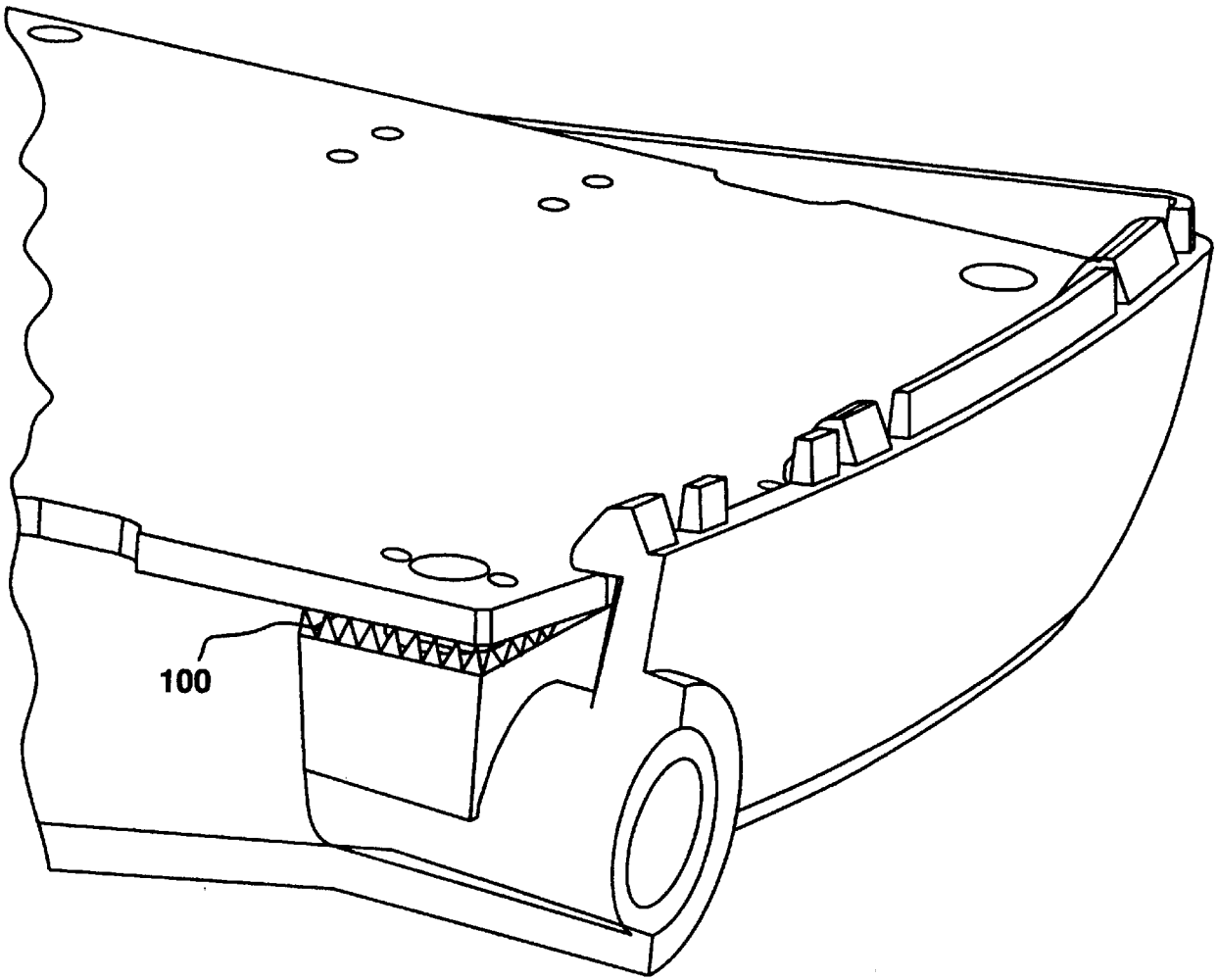
FIG. 4 illustrates the interconnection between the antenna connector and a printed circuit board.

The connector flange 35 extends perpendicularly from the barrel 25 and defines a chamber 40 for receiving the insulated connector insert 15. The chamber 40 defines a pair of opposed slots 45 for engaging the insulated connector insert 15. The base 50 of the connector flange 35 defines an opening through which a portion of the shaped metal contact 20 extends to enable connection with a printed circuit board. The base 50 of connector flange 35 contacts the ground plane of a printed circuit board (PCB) such that the entire housing acts as a ground shield. The connection between the PCB ground plane and the base 50 of the housing 10 is maintained by a conductive foam 100 which compresses between the board and housing as shown in FIG. 4.

The insulated connector insert 15 consists of a central body 60 having guide rails 65 extending from the sides thereof. The guide rails 65 engage the opposed slots 45 of the connector flange 35 such that the insulated connector insert 15 may be secured within the antenna housing 10. The insulated connector insert 15 is molded from plastic, for example, poly-carbonate, and is shaped to receive the shaped metal contact 20 over the central body 60 such that the contact engages the RF feed points of the antenna and a printed circuit board.

The formed metal contact 20 is snapped around the central body 60. The formed metal contact 20 includes an antenna portion 80, base portion 85, and PCB portion 90. The antenna portion 80 angles upward from the insulated connector insert 15 in a v-shape to provide a secure contact with the feed point of an inserted antenna 27. The PCB portion 90 extends slightly outward from the base 50 of the connector flange 35 such that the contact 20 maintains galvanic contact with the PCB RF feed point. The formed metal contact 20 is stapled, soldered or otherwise connected to the insulated connector insert 15 via base portion 85.

Insertion of the combined connector insert 15 and formed metal contact 20 assembly within the chamber 40 positions the formed metal contact 20 such that it is substantially surrounded by the housing 10 of the antenna connector. The housing 10 acts as a ground shield for the antenna connector 10 when it is connected with the ground plane of a PCB. Thus, the RF contact between the antenna and the PCB is shielded from external interference by the barrel 25 of the housing 10.

Figure 5:
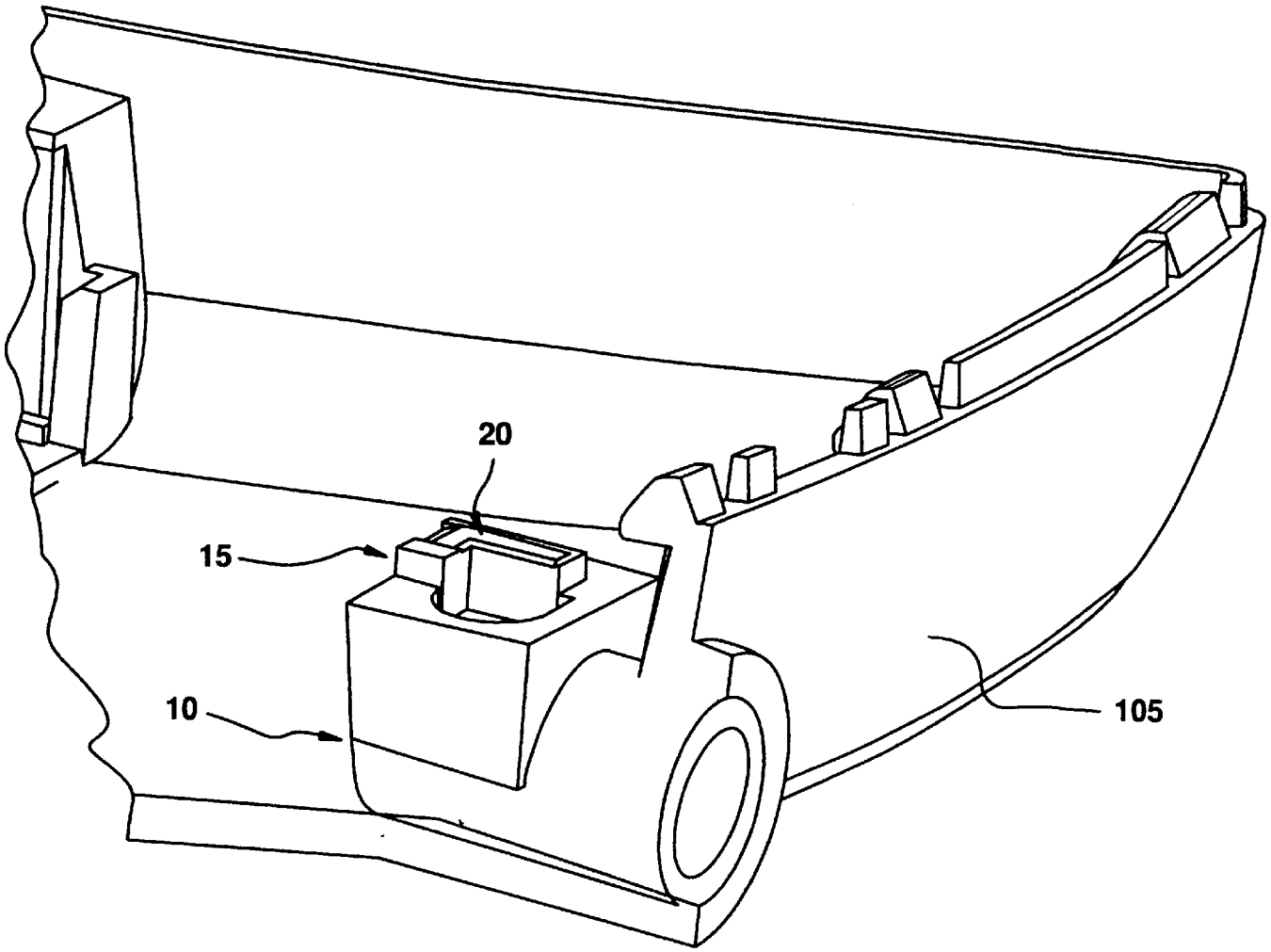
FIG. 5 is a perspective view illustrating connection of the antenna connector within the housing of a cellular telephone.

The antenna connector is heat staked into a plastic housing 105 of a cellular telephone unit as shown in FIG. 5. When the connector is positioned in this manner the PCB portion 90 of the formed metal contact 20 will engage the RF feed of a printed circuit board. Then a PCB board is snapped into place in the telephone housing.

Although a preferred embodiment of the method and apparatus of the present invention has been illustrated in the accompanying Drawings and described in the foregoing Detailed Description, it is understood that the invention is not limited to the embodiment disclosed, but is capable of numerous rearrangements, modifications, and substitutions without departing from the spirit of the invention as set forth and defined by the following claims.

What is claimed is:

1. An antenna connector comprising:

a housing defining a first interior chamber into which an antenna is inserted and a second interior chamber, the housing further engaging a ground plane of a printed circuit board such that the housing acts as a ground shield for the antenna within the first interior chamber and for the second interior chamber;

means for contacting an RF feed point of the antenna; and an insulated insert connected to the means for contacting, the insulated insert configured for insertion into the second interior chamber of the housing such that the means for contacting engages the RF feed point of the antenna within the first chamber and the housing acts as a ground shield for the connection between the means for contacting and the RF feed point.

2. The antenna connector of claim 1 wherein the means for contacting further defines means for connecting with an RF feed of a printed circuit board.

3. The antenna connector of claim 1 wherein the housing further enables extension and retraction of a retractable antenna within the first interior chamber.

4. The antenna connector of claim 1 wherein the first interior chamber threadedly engages the antenna.

5. The antenna connector of claim 1 wherein the means for contacting comprises a formed metal contact.

6. The antenna connection of claim 5 wherein the insulated insert comprises a plastic connector inserted within the formed metal contact.

7. An antenna connector comprising:

a metal housing defining a first interior chamber for receiving an antenna and a second interior chamber, the housing acting as a ground shield for the second interior chamber when connected to a ground plane of a printed circuit board;

a formed metal contact for engaging an RF feed point of the antenna and an RF connector of the printed circuit board; and an insulated connector inserted within the formed metal contact, the connector configured for insertion into the second interior chamber such that the formed metal contact engages the RF feed point of the antenna and is substantially surrounded by the metal housing such that the metal housing acts as a ground shield for the formed metal contact.

8. The antenna connector of claim 7 wherein the housing further enables extension and retraction of a retractable antenna within the first interior chamber.

9. The antenna connector of claim 7 wherein the first interior chamber threadedly engages the antenna.

10. The antenna connector of claim 7 wherein the housing comprises a cast metal conductor.

11. The antenna connector of claim 10 wherein the housing is plated to prevent oxidation and promote conductivity.

12. An antenna connector, comprising:

an RF feed connector for contacting an RF feed point of an antenna engaging the antenna connector;

a ground connector for engaging the ground plane of a printed circuit board; and a housing substantially surrounding the RF feed connector and integral with the ground connector such that the housing forms a ground shield for the RF feed connector and the contacted RF feed point.

13. The antenna connector of claim 12 wherein the housing further comprises means for receiving a retractable antenna.

14. The antenna connector of claim 12, further including means for insulating the RF feed connector from the ground shield.

* * * * *